US006979251B2

(12) United States Patent
Berman

(10) Patent No.: US 6,979,251 B2
(45) Date of Patent: Dec. 27, 2005

(54) METHOD AND APPARATUS TO ADD SLURRY TO A POLISHING SYSTEM

(75) Inventor: Michael J. Berman, West Linn, OR (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 10/607,116

(22) Filed: Jun. 26, 2003

(65) Prior Publication Data

US 2004/0266321 A1 Dec. 30, 2004

(51) Int. Cl.[7] ..... B24B 57/00
(52) U.S. Cl. ..... 451/60; 451/288; 451/398; 451/446
(58) Field of Search ..... 451/41, 56, 285, 451/286, 288, 60, 398, 446, 447

(56) References Cited

U.S. PATENT DOCUMENTS 5,695,392 A * 12/1997 Kim ..... 451/288
5,902,173 A * 5/1999 Tanaka ..... 451/56
5,931,725 A * 8/1999 Inaba et al. ..... 451/56
5,944,593 A * 8/1999 Chiu et al. ..... 451/442
6,241,582 B1 * 6/2001 Lin et al. ..... 451/41
6,347,979 B1 * 2/2002 Drill ..... 451/41
6,458,020 B1 * 10/2002 Brigante et al. ..... 451/285
6,682,409 B2 * 1/2004 Cheng ..... 451/286

* cited by examiner

*Primary Examiner*—George Nguyen
(74) *Attorney, Agent, or Firm*—Trexler, Bushnell, Giangiorgi & Blackstone, Ltd.

(57) ABSTRACT

A semiconductor wafer is wetted with slurry by injecting the slurry into at least one channel which is provided in a wear ring, while the wear ring is holding the wafer and is pressed against a polishing pad. Preferably, the channel in the wear ring includes a plurality of outlets, and the outlets provide that the slurry can exit the wear ring and contact the polishing pad. Providing that the wear ring includes at least one channel and that slurry is injected into the channel during the polishing process provides that slurry is introduced between the wear ring and the polishing pad and this greatly increases the amount of slurry getting to the wafer.

6 Claims, 2 Drawing Sheets

METHOD AND APPARATUS TO ADD SLURRY TO A POLISHING SYSTEM

BACKGROUND

The present invention generally relates to methods and apparatuses for adding slurry to a semiconductor wafer polishing system, and more specifically relates to a method for adding slurry in a semiconductor wafer polishing system by adding the slurry through a wear ring. The present invention also specifically relates to a wear ring which is configured to facilitate the adding of a slurry therethrough, in a semiconductor wafer polishing system.

An IC chip is a sandwiched, multiple layer structure which typically includes a silicon substrate, dielectric layers, metal interconnects, devices and so on. Every layer is formed by deposition, photolithographic, etching, as well as other, techniques. Every layer must be planar and, as the features get smaller, the requirement for planarity gets more stringent. Chemical Mechanical Polishing (CMP) plays an important part in planarizing every layer before the next top layer is deposited. The CMP process involves pressing the face of the wafer to be polished against a compliant polymeric polishing pad and generating relative motion between the interface between the wafer and the pad. A slurry consisting of abrasives and chemicals is fed in between the interface between the wafer and the pad. The combined chemical action of the chemicals in the slurry and the mechanical action of the abrasives cause material to be removed from the wafer. A typical CMP setup looks very similar to a lapping machine, but the precision is much higher and there is a lot more sophistication.

One of the most commonly-used devices for polishing a semiconductor wafer is a rotational format CMP machine as illustrated in FIG. 1. The wafer 10 is held in a wafer carrier by a wear ring 12, and is pressed against a polishing pad 14 which is disposed on a polishing table 16. Both the wafer ring 12 and polishing table 16 are then rotated (as indicated by arrows 18 in FIG. 1), and slurry is supplied on the pad 14.

Presently, there are two widely-used ways of adding slurry to a semiconductor wafer polishing system. A first method provides that slurry is added through the polishing pad 14. A second method provides that slurry is dripped on the polishing pad 14, proximate the wear ring 12. The method wherein slurry is added through the pad is generally regarded as being the preferred method because only about half as much slurry is used. This is a major cost savings as slurry is costing up to $4.00 per step, with ten or more steps being performed per wafer. In addition to providing a cost savings as a result of less slurry being used, the method wherein slurry is added through the pad also provides that the full wafer surface is wetted with slurry at the same time, and this is advantageous.

A wear ring (indicated with reference numeral 12 in FIG. 1) is a ceramic ring which holds the wafer 10 during the polishing process. Generally, the wear ring is a major barrier to the slurry getting to the wafer. As the wafer moves on the polishing table, the wear ring pushes much, if not most, of the slurry away from the wafer. The bigger the wafer, the bigger the problem this presents.

Generally, two methods have been widely-used with regard to attempting to improve getting the slurry across the wear ring and under the wafer. In one method, grooves are provided in the polishing pad, both in the x and y directions and concentric. In the other method, grooves are not only provided in the polishing pad, but also in the wear ring. Regardless of which method is employed, too much slurry must be used, and the problem persists of the slurry not getting to the wafer due to the wear ring blocking the slurry.

OBJECTS AND SUMMARY

An object of an embodiment of the present invention is to provide a method and wear ring wherein a semiconductor wafer can be wetted with slurry without having to use too much slurry.

Another object of an embodiment of the present invention is to provide a method and wear ring wherein a semiconductor wafer can be wetted with slurry without the wear ring blocking the slurry.

Still another object of an embodiment of the present invention is to provide a method and wear ring wherein slurry is injected between the wear ring and pad, greatly increasing the slurry getting to the wafer.

Yet another object of an embodiment of the present invention is to provide a method and wear ring which can be used in association with a plurality of types of slurry injections methods, such as where the slurry is a two part slurry and where a drip slurry system is used.

Briefly, and in accordance with at least one of the foregoing objects, an embodiment of the present invention provides a method of wetting a semiconductor wafer with slurry wherein the slurry is injected into at least one channel which is provided in a wear ring disposed on a polishing pad and holding a wafer. Preferably, the channel in the wear ring includes a plurality of outlets, and the outlets provide that the slurry can exit the wear ring and contact the polishing pad. This greatly increases the amount of slurry getting to the wafer.

Another embodiment of the present invention provides a wear ring which is configured to hold a wafer and is configured to be disposed on a polishing pad. The wear ring includes at least one channel, and the channel preferably includes a plurality of outlets which provide that, when slurry is injected into the channel, the slurry can exit the wear ring wear ring and contact the polishing pad.

BRIEF DESCRIPTION OF THE DRAWINGS

The organization and manner of the structure and operation of the invention, together with further objects and advantages thereof, may best be understood by reference to the following description, taken in connection with the accompanying drawing, wherein.

DESCRIPTION

Figure 1:
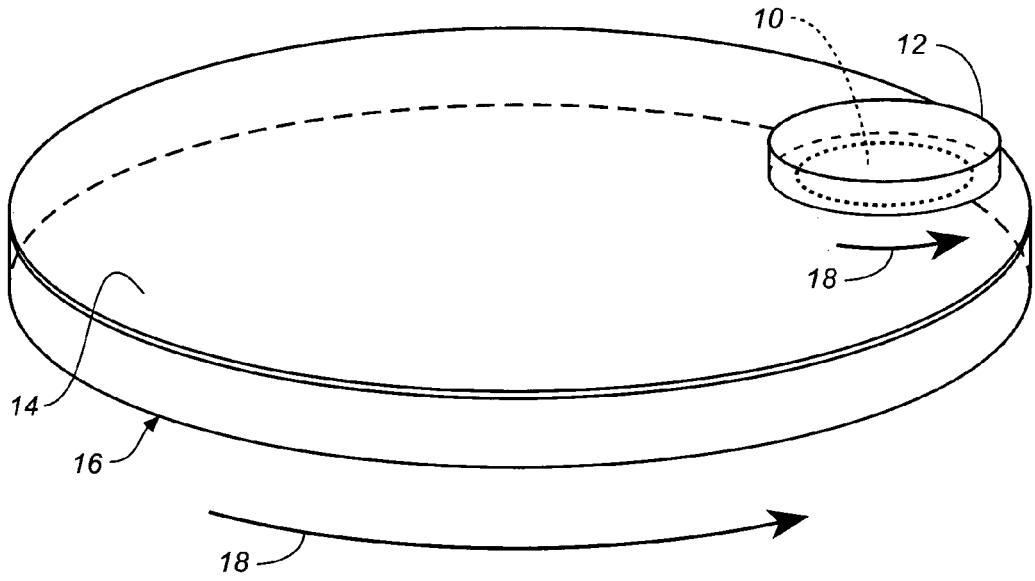
FIG. 1 (PRIOR ART)
FIG. 1 illustrates a prior art wear ring holding a wafer and pressing the wafer to a polishing pad on a polishing table.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
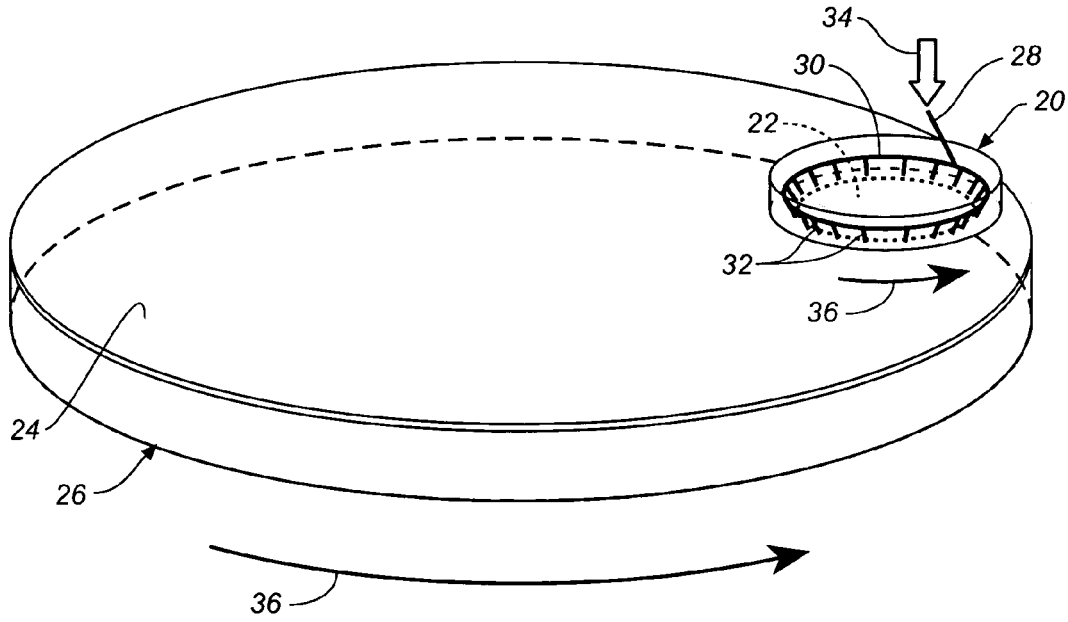
FIG. 2 illustrates a wear ring, which is in accordance with an embodiment of the present invention, holding a wafer and pressing same to a polishing pad on a polishing table.
Figure 3:
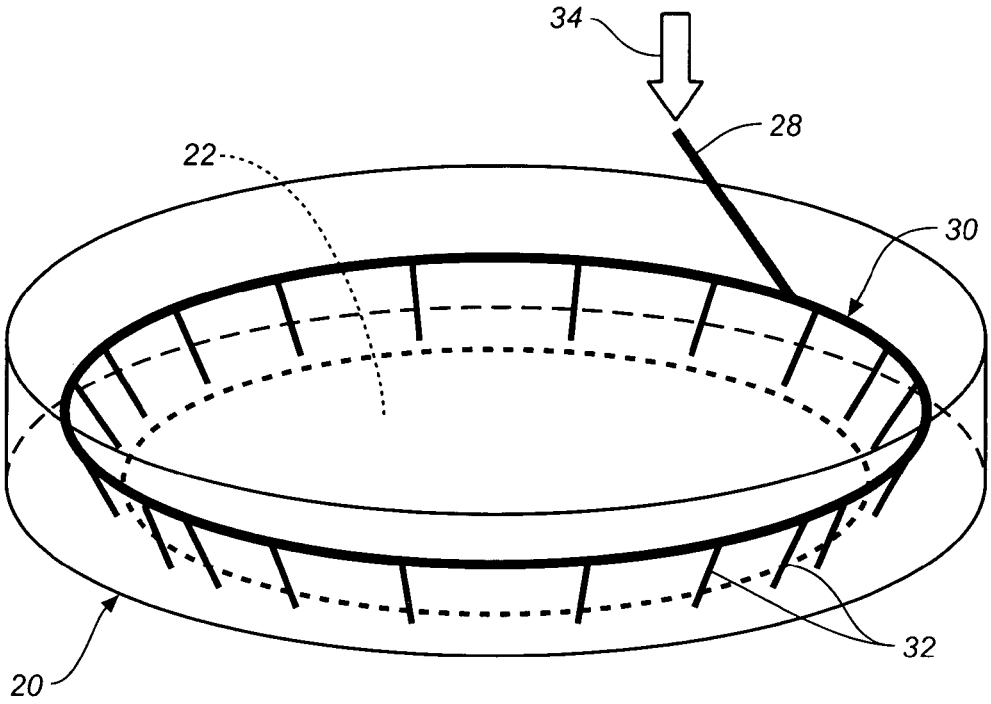
FIG. 3 provides an enlarged view of the wear ring of FIG. 2, depicting the wear ring holding the wafer.

FIGS. 2 and 3 illustrate a wear ring which is in accordance with an embodiment of the present invention. As shown, the wear ring 20 is configured to hold a semiconductor wafer 22 and is configured to be pressed to a polishing pad 24 on a polishing table 26. The wear ring 20 includes an inlet 28 which is in communication with at least one channel or distribution loop 30 in the wear ring 20. A plurality of outlets 32 are in communication with the channel 30. The wear ring 20 is configured such that slurry is injectable (the injection of slurry is represented by arrow 34 in FIGS. 2 and 3) into the at least one channel 30 such that the slurry exits the outlets 32 in the wear ring 20 and contacts the polishing pad 24 on the polishing table 26. Preferably, the wear ring 20 is pressed against the polishing pad 24, and both the polishing table 26 and wear ring 20 are rotated (as represented by arrows 36 in FIG. 2).

While FIGS. 2 and 3 illustrate one embodiment of the wear ring 20, other embodiments are entirely possible. For example, while FIGS. 2 and 3 depict the channel 30 being within the wear ring 20, the channel 30 can instead be provided as being formed in the underside of the wear ring 20 so that the slurry can flow into the channel and have full contact with the pad 24. Also, while the channel 30 and outlets 32 are shown centered in FIGS. 2 and 3, the channel 30 and outlets 32 can instead be provided nearer the wafer.

Hence, a method in accordance with an embodiment of the present invention provides that the wear ring 20 is used to hold the wafer 22 while being pressed to the polishing pad 24. Then, slurry is injected the at least one channel 30 via the inlet 28, thereby causing the slurry to exit the outlets 32 in the wear ring 20 and contact the polishing pad 24. Preferably, both the wear ring 20 and polishing table 26 are rotated as the slurry is injected. Providing that the wear ring includes at least one channel and that slurry is injected into the channel during the polishing process provides that slurry is introduced between the wear ring and the polishing pad and this greatly increases the amount of slurry getting to the wafer.

While FIGS. 2 and 3 illustrate the wear ring 20 having a single channel or distribution loop 32, a plurality of channels can be provided in the wear ring, such as for use with two-part slurries (i.e., Hitachi). Additionally, the wear ring can be used in connection with a plurality of types of slurry injections, such as with a drip-type slurry system.

While an embodiment of the present invention is shown and described, it is envisioned that those skilled in the art may devise various modifications of the present invention without departing from the spirit and scope of the appended claims.

What is claimed is:

1. A method of wetting a semiconductor wafer with slurry, said method comprising: using a wear ring to hold the wafer to a polishing pad, said wear ring including at least one inlet; at least one peripheral channel inside the wear ring, said inlet being in communication with said channel inside the wear ring; and a plurality of outlets all of which are in communication with the at least one peripheral channel which is inside the wear ring; injecting the slurry into the inlet such that the slurry goes into the peripheral channel inside the wear ring, exits all of the outlets and contacts the polishing pad.

2. A method as recited in claim 1, further comprising pressing the wear ring against the polishing pad.

3. A method as recited in claim 1, wherein the polishing pad is disposed on a polishing table and said method further comprises rotating at least one of the wear ring and the polishing table.

4. A method as recited in claim 1, wherein the polishing pad is disposed on a polishing table and said method further comprises rotating both the wear ring and the polishing table.

5. A wear ring which is configured to hold a semiconductor wafer and is configured to be disposed on a polishing pad, said wear ring including at least one inlet; at least one peripheral channel inside the wear ring, said inlet being in communication with said channel inside the wear ring; and a plurality of outlets all of which are in communication with the at least one peripheral channel which is inside the wear ring, said wear ring configured such that slurry is injectable into the inlet such that the slurry goes into the peripheral channel inside the wear ring, exits all of the outlets and contacts the polishing pad.

6. A wear ring as recited in claim 5, wherein said wear ring is pressable against the polishing pad.

* * * * *